US011211677B2

(12) United States Patent
Guo et al.

(10) Patent No.: US 11,211,677 B2
(45) Date of Patent: Dec. 28, 2021

(54) FILTERING APPARATUS

(71) Applicant: HUAWEI TECHNOLOGIES CO., LTD., Guangdong (CN)

(72) Inventors: Jiyong Guo, Shanghai (CN); Xiaoliang Du, Shanghai (CN); Dan Liang, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 17/067,252

(22) Filed: Oct. 9, 2020

(65) Prior Publication Data

US 2021/0028524 A1 Jan. 28, 2021

Related U.S. Application Data

(63) Continuation of application No. PCT/CN2019/081997, filed on Apr. 10, 2019.

(30) Foreign Application Priority Data

Apr. 11, 2018 (CN) ..... 201810319907.2

(51) Int. Cl.
*H01P 1/20* (2006.01)

(52) U.S. Cl.
CPC ..... *H01P 1/20* (2013.01)

(58) Field of Classification Search
CPC ..... H01P 1/20
See application file for complete search history.

(56) References Cited

U.S. PATENT DOCUMENTS 6,496,087 B1 12/2002 Hattori et al.
7,283,022 B2 10/2007 Andreasson et al.
(Continued)

FOREIGN PATENT DOCUMENTS

CA 1081808 A 7/1980
CN 1373532 A 10/2002
(Continued)

OTHER PUBLICATIONS

Office Action issued in Chinese Application No. 201810319907.2 dated Sep. 28, 2020, 15 pages (with English translation).
(Continued)

*Primary Examiner* — Robert J Pascal
*Assistant Examiner* — Kimberly E Glenn
(74) *Attorney, Agent, or Firm* — Fish & Richardson P.C.

(57) ABSTRACT

This application discloses a filtering apparatus, including: a coupling channel distinguishing component, dividing a coupling channel between a first filtering component and a second filtering component into a plurality of independent coupling channels, and it includes a channel distinguishing component and at least one decoupling component, the channel distinguishing component is configured to divide the coupling channel into a plurality of independent channels, and the decoupling component is configured to decouple the plurality of independent channels into the plurality of independent coupling channels; and at least one adjusting component, each of the adjusting component is configured to adjust a preset coupling scheme of a corresponding independent coupling channel, each of the at least one adjusting component is located in the corresponding independent coupling channel, and each of the adjusting component is located in a corresponding projection area.

10 Claims, 3 Drawing Sheets

(56) References Cited

U.S. PATENT DOCUMENTS

| | | | | |
|---|---|---|---|---|
| 2003/0117244 | A1* | 6/2003 | Matsuura | H01P 1/2086 333/219 |
| 2004/0196120 | A1* | 10/2004 | Andoh | H01P 1/2086 333/202 |

FOREIGN PATENT DOCUMENTS

| | | | |
|---|---|---|---|
| CN | 1691404 | A | 11/2005 |
| CN | 101040403 | A | 9/2007 |
| CN | 101901952 | A | 12/2010 |
| CN | 102544649 | A | 7/2012 |
| CN | 102593561 | A | 7/2012 |
| CN | 102800909 | A | 11/2012 |
| CN | 202839929 | U | 3/2013 |
| CN | 103151586 | A | 6/2013 |
| CN | 103972621 | A | 8/2014 |
| CN | 104170162 | A | 11/2014 |
| CN | 105226354 | A | 1/2016 |
| CN | 107017454 | A | 8/2017 |
| CN | 107394327 | A | 11/2017 |
| CN | 108336458 | A | 7/2018 |
| EP | 0593661 | A1 | 4/1994 |
| EP | 0656670 | A2 | 6/1995 |
| EP | 1858109 | A1 | 11/2007 |
| WO | 1993001626 | A1 | 1/1993 |
| WO | 2015100541 | A1 | 7/2015 |

OTHER PUBLICATIONS

PCT International Search Report and Written Opinion issued in International Application No. PCT/CN2019/081997 dated May 29, 2019, 15 pages (with English translation).

Extended European Search Report in European Application No. 19786027.3, dated Mar. 17, 2021, 12 pages.

* cited by examiner

FILTERING APPARATUS

CROSS-REFERENCE TO RELATED APPLICATIONS

This application is a continuation of International Application No. PCT/CN2019/081997, filed on Apr. 10, 2019, which claims priority to Chinese Patent Application No. 201810319907.2, filed on Apr. 11, 2018. The disclosures of the aforementioned applications are hereby incorporated by reference in their entireties.

TECHNICAL FIELD

The present invention relates to the field of electronic technologies, and in particular, to a filtering apparatus.

BACKGROUND

A multi-mode filter features miniaturization, a high Q/V ratio, and high power, and therefore is widely applied to existing communications systems. However, in actual application, because mutual coupling between multi-mode components is relatively complex, the coupling between the multi-mode components is difficult to be controlled independently, testing and adjustment have large mutual impact, and there is a large quantity of spurious couplings. As a result, designing and manufacturing of the multi-mode filter are very difficult, preventing large-scale application of the multi-mode filter.

SUMMARY

Embodiments of this application provide a filtering apparatus, to reduce difficulty in adjusting a coupling degree between a first filtering component and a second filtering component.

According to a first aspect, a filtering apparatus is provided. The apparatus includes:

a casing;

a first filtering component and a second filtering component, where the first filtering component is a multi-mode component, the second filtering component is a single-mode filtering component, the first filtering component and the second filtering component are separately disposed on two sides of the casing, and the first filtering component and the second filtering component are coupled to each other through a coupling channel;

a coupling channel distinguishing component, located between the first filtering component and the second filtering component, and dividing the coupling channel between the first filtering component and the second filtering component into a plurality of independent coupling channels, where the plurality of independent coupling channels are in a one-to-one correspondence with a plurality of preset coupling schemes, the coupling channel distinguishing component includes a channel distinguishing component and at least one decoupling component, the channel distinguishing component is configured to divide the coupling channel into a plurality of independent channels, and the at least one decoupling component is configured to decouple the plurality of independent channels into the plurality of independent coupling channels; and at least one adjusting component, where the at least one adjusting component is in a one-to-one correspondence with the at least one decoupling component, each of the at least one adjusting component is configured to adjust a preset coupling scheme of a corresponding independent coupling channel, each of the at least one adjusting component is located in the corresponding independent coupling channel, an axis of the corresponding independent coupling channel is used as a first straight line, and each of the at least one adjusting component is located in a corresponding projection area, where the projection area includes a corresponding enhancing component and projections of the corresponding enhancing component in a direction parallel to the first straight line and in a direction perpendicular to the first straight line.

With reference to the first aspect, the channel distinguishing component includes at least one cylinder, and a material of the cylinder is a metal material.

With reference to the first aspect, a structure of the decoupling component may be one of at least the following three types.

In a first manner, the decoupling component is approximately L-shaped from a top view, a vertical segment of the L-shaped decoupling component is perpendicular to electromagnetic field of any mode of the first filter, and a horizontal segment of the L-shaped decoupling component is parallel to any one of the independent channels; and from a side view, the decoupling component is Π-shaped, the Π-shaped decoupling component includes three segments, a first segment is perpendicular to a bottom of the casing, a second segment is parallel to the bottom of the casing, and a third segment is perpendicular to the bottom of the casing.

Optionally, the first segment is connected to the bottom of the casing, and the third segment is connected to the bottom of the casing; the first segment is not connected to the bottom of the casing, and the third segment is connected to the bottom of the casing; the first segment is connected to the bottom of the casing, and the third segment is not connected to the bottom of the casing; or the first segment is not connected to the bottom of the casing, and the third segment is not connected to the bottom of the casing.

In a second manner, the decoupling component is approximately L-shaped from a top view, a vertical segment of the L-shaped decoupling component is perpendicular to electromagnetic field of any mode of the first filter, and a horizontal segment of the L shape is parallel to any one of the independent channels; and from a side view, the decoupling component is upside-down L-shaped, the upside-down L-shaped decoupling component includes two segments, a first segment is perpendicular to a bottom of the casing, and a second segment is parallel to the bottom of the casing. Optionally, the first segment is connected to the bottom of the casing, or the first segment is not connected to the bottom of the casing.

In a third manner, the decoupling component is approximately L-shaped from a top view, a vertical segment of the L-shaped decoupling component is perpendicular to electromagnetic field of any mode of the first filter, and a horizontal segment of the L-shaped decoupling component is parallel to any one of the independent channels; and from a side view, the decoupling component is ||-shape, the ||-shaped decoupling component includes two segments, a first segment is perpendicular to a bottom of the casing, and a second segment is perpendicular to the bottom of the casing.

Optionally, the first segment is connected to the bottom of the casing, and the second segment is connected to the bottom of the casing; the first segment is not connected to the bottom of the casing, and the second segment is connected to the bottom of the casing; the first segment is connected to the bottom of the casing, and the second segment is not connected to the bottom of the casing; or the first segment is not connected to the bottom of the casing, and the second segment is not connected to the bottom of the casing.

With reference to the first aspect, the filtering apparatus further includes at least one enhancing component, and each of the at least one enhancing component is configured to enhance a coupling degree of a preset coupling scheme of a corresponding independent coupling channel.

Optionally, each of the at least one enhancing component is made of a metal material.

According to the foregoing solution, the coupling channel distinguishing component is located between the first filtering component and the second filtering component, and divides the coupling channel between the first filtering component and the second filtering component into the plurality of independent coupling channels, and the any one of the at least one enhancing component is configured to enhance the coupling degree of the preset coupling scheme of the corresponding independent coupling channel. According to the foregoing solution, different independent coupling channels can be independent of each other. When a preset coupling scheme corresponding to one of the independent coupling channels is adjusted, a preset coupling scheme corresponding to another independent coupling channel is not affected, thereby reducing difficulty in adjusting the coupling degree between the first filtering component and the second filtering component.

BRIEF DESCRIPTION OF DRAWINGS

To describe technical solutions in embodiments of this application more clearly, accompanying drawings for describing the embodiments are briefly described below. Apparently, the accompanying drawings in the following description show merely some embodiments of this application, and a person of ordinary skill in the art may still derive other drawings from these accompanying drawings without creative efforts.

DESCRIPTION OF EMBODIMENTS

A casing of a filter usually includes at least one of a single-mode component and a multi-mode component. For ease of understanding, the following first separately describes the single-mode component and the multi-mode component in detail.

A single preset frequency is usually allowed to pass through the single-mode component. That is, in an ideal status, neither an amplitude value nor a phase of the preset frequency is distorted after the preset frequency passes through the single-mode component, and an amplitude value of a non-preset frequency is attenuated to zero after the non-preset frequency passes through the single-mode component. A target frequency band is allowed to pass through a mode component formed by coupling two single-mode components (for example, a first single-mode component and a second single-mode component), and a frequency band between a first preset frequency of the first single-mode component and a second preset frequency of the second single-mode component is a center frequency band of the target frequency band. Stronger coupling between the first single-mode component and the second single-mode component indicates wider bandwidth of the target frequency band, and weaker coupling between the first single-mode component and the second single-mode component indicates narrower bandwidth of the target frequency band. The single-mode component is usually made of a material having a relatively high dielectric constant, for example, porcelain, mica, glass, plastic, or one of various metal oxides. The single-mode component may be a single-mode cavity that is filled with pure rectified water, dry air, or the like. This is not specifically limited herein. The single-mode component is usually in a cylindrical shape. Certainly, the single-mode component may alternatively be in another shape. This is not specifically limited herein.

Figure 1:
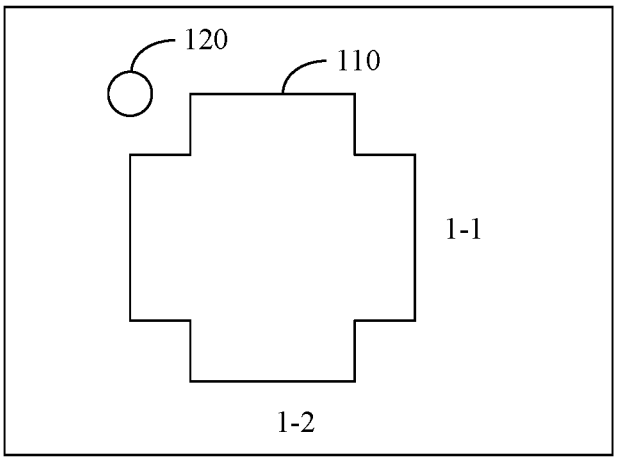
FIG. 1 is a schematic structural diagram of a dual-mode component in the prior art.

A multi-mode component can implement a filtering function equivalent to that of a plurality of single-mode components. A dual-mode component is used as an example. As shown in FIG. 1, a dual-mode component 110 may be cross-shaped, where a horizontal segment of the cross-shaped dual-mode component is a first mode 1-1, and a vertical segment of the cross-shaped dual-mode component is a second mode 1-2. The first mode 1-1 and the second mode 1-2 are each equivalent to a single-mode component. That is, a first preset frequency is allowed to pass through the first mode 1-1, and a second preset frequency is allowed to pass through the second mode 1-2. When the first mode 1-1 is coupled to the second mode 1-2, a target frequency band is allowed to pass through the multi-mode component 110, and a frequency band between the first preset frequency of the first mode 1-1 and the second preset frequency of the second mode 1-2 is a center frequency band of the target frequency band. Stronger coupling between the first mode 1-1 and the second mode 1-2 indicates wider bandwidth of the target frequency band, and weaker coupling between the first mode 1-1 and the second mode 1-2 indicates narrower bandwidth of the target frequency band. Strength of the coupling between the first mode 1-1 and the second mode 1-2 may be adjusted by using an adjustment fastening component 120 near the multi-mode component. When the adjustment fastening component 120 is screwed in deeper, the coupling between the first mode 1-1 and the second mode 1-2 is stronger. When the adjustment fastening component 120 is screwed in shallower, the coupling between the first mode 1-1 and the second mode 1-2 is weaker. It may be understood that the dual-mode component in the foregoing example is in the cross shape, and in another implementation, the dual-mode component may alternatively be in another shape. This is not specifically limited herein. The multi-mode component 110 is usually made of a material having a relatively high dielectric constant, for example, porcelain, mica, glass, plastic, or one of various metal oxides. The multi-mode component may be a multi-mode cavity that is filled with pure rectified water, dry air, or the like. This is not specifically limited herein. The adjustment fastening component 120 is usually made of a material having a relatively low dielectric constant, for example, a metal material such as copper, aluminum, or iron, or a semiconductor material such as silicon dioxide. It needs to be understood that the foregoing example is merely used as an example, and does not need to constitute a specific limitation.

In a specific embodiment, the casing of the filter is usually a solid structure made of a material having a low dielectric constant, for example, a metal material such as copper, aluminum, or iron, or a semiconductor material such as silicon dioxide. It needs to be understood that the foregoing example is merely used as an example, and does not need to constitute a specific limitation.

In the prior art, a first filtering component and a second filtering component are separately disposed at two ends of the casing of the filter, and the first filtering component and the second filtering component are coupled by using a coupling channel of the casing, to make the filter closer to an ideal filter, that is, a filter in which neither an amplitude value nor a phase of a frequency component in a passband is distorted, and an amplitude value of a frequency component in a stopband is attenuated to zero.

Figure 2:
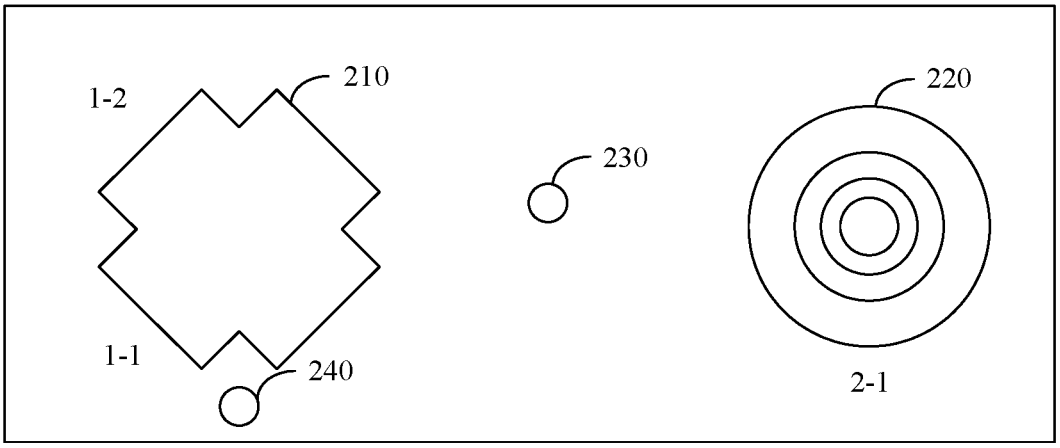
FIG. 2 is a schematic structural diagram of a filtering apparatus in the prior art.

As shown in FIG. 2, a coupling scheme between a first filtering component 210 and a second filtering component 220 may be designed as required. For example, the first filtering component 210 is a dual-mode component, and the second filtering component 220 is a single-mode component. The first filtering component 210 and the second filtering component 220 may be coupled in one of the following preset coupling schemes.

In a first preset coupling scheme, a first mode 1-1 of the first filtering component 210 is coupled to a second mode 1-2 of the first filtering component 210, and then the second mode 1-2 of the first filtering component 210 is coupled to a single-mode component 2-1 of the second filtering component 220 through a coupling channel.

In a second preset coupling scheme, a second mode 1-2 of the second filtering component 220 is coupled to a first mode 1-1 of the first filtering component 210, and then the first mode 1-1 of the first filtering component 210 is coupled to a single-mode component 2-1 of the second filtering component 220 through a coupling channel.

When any preset coupling scheme between the first filtering component 210 and the second filtering component 220 needs to be adjusted, a first adjustment fastening component 230 disposed between the first filtering component 210 and the second filtering component 220 may be adjusted. For example, when coupling between the second mode 1-2 of the first filtering component 210 and the single-mode component 2-1 of the second filtering component 220 needs to be adjusted, the first adjustment fastening component 230 between the first filtering component 210 and the second filtering component 220 may be adjusted. However, because the coupling between the second mode 1-2 of the first filtering component 210 and the single-mode component 2-1 of the second filtering component 220, and coupling between the first mode 1-1 of the first filtering component 210 and the single-mode component 2-1 of the second filtering component 220 are in a same spatial area, the coupling between the first mode 1-1 of the first filtering component 210 and the single-mode component 2-1 of the second filtering component 220 is inevitably affected.

To compensate for such impact, a second adjustment fastening component 240 located between the first mode 1-1 of the first filtering component 210 and the second mode 1-2 of the first filtering component 210 needs to be adjusted. However, when the second adjustment fastening component 240 is adjusted, inevitably, the coupling between the second mode 1-2 of the first filtering component 210 and the single-mode component 2-1 of the second filtering component 220, and the coupling between the first mode 1-1 of the first filtering component 210 and the single-mode component 2-1 of the second filtering component 220 are affected. Therefore, after the second adjustment fastening component 240 is adjusted, the first adjustment fastening component 230 needs to be adjusted again. Adjusting can be finally completed only after such adjustment is performed a plurality times.

To resolve the foregoing problem, an embodiment of this application provides a filtering apparatus, so that the preset coupling schemes between the first filtering component and the second filtering component can be independent, thereby reducing complexity of coupling adjustment.

Figure 3:
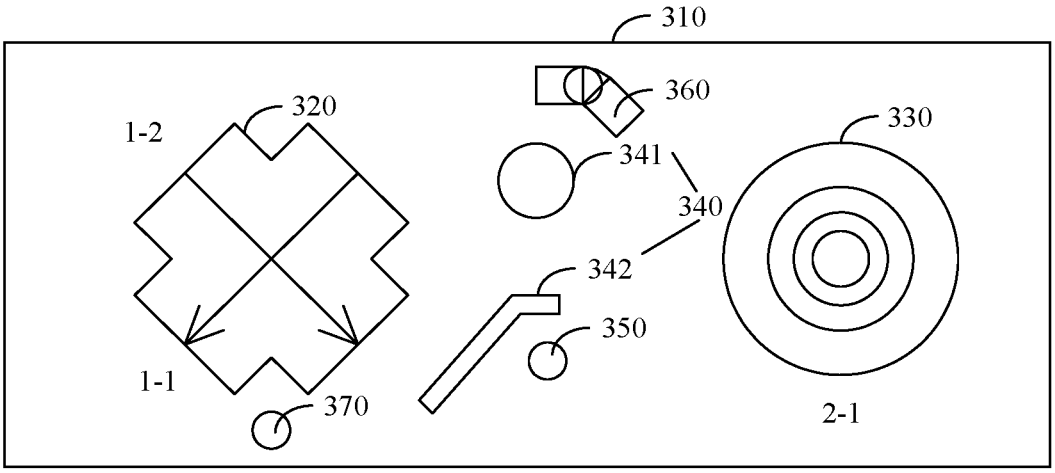
FIG. 3 is a top view of a filtering apparatus according to an embodiment of this application.

FIG. 3 is a top view of the filtering apparatus according to this embodiment of this application. The filtering apparatus in this embodiment of this application includes a casing 310, a first filtering component 320, a second filtering component 330, and a coupling channel distinguishing component 340. The first filtering component 320 is a multi-mode component, and the second filtering component 330 is a single-mode filtering component. The first filtering component 320 and the second filtering component 330 are separately disposed on two sides of the casing 310. The first filtering component 320 and the second filtering component 330 are coupled to each other through a coupling channel. The coupling channel distinguishing component 340 is located between the first filtering component 320 and the second filtering component 330, and divides the coupling channel between the first filtering component 320 and the second filtering component 330 into a plurality of independent coupling channels. The plurality of independent coupling channels are in a one-to-one correspondence with a plurality of preset coupling schemes.

In a specific embodiment of this application, the coupling channel distinguishing component 340 includes a channel distinguishing component 341 and a decoupling component 342.

In a specific embodiment, the channel distinguishing component 341 is configured to divide the coupling channel into a plurality of independent channels.

For example, the channel distinguishing component 341 is disposed between the first filtering component 320 and the second filtering component 330. A cylinder divides the coupling channel between the first filtering component 320 and the second filtering component 330 into two independent channels: a first independent channel and a second independent channel. When only the channel distinguishing component 341 is disposed, and the decoupling component 342 is not disposed, the previous first preset coupling scheme and second preset coupling scheme between the first filtering component 320 and the second filtering component 330 are changed as follows.

In the first preset coupling scheme, a first mode 1-1 of the first filtering component 320 is coupled to a second mode 1-2 of the first filtering component 320, then a part of the second mode 1-2 of the first filtering component 320 is coupled to a single-mode mode 2-1 of the second filtering component 330 through the first independent channel, and the other part of the second mode 1-2 of the first filtering component 320 is coupled to the single-mode mode 2-1 of the second filtering component 330 through the second independent channel.

In the second preset coupling scheme, a second mode 1-2 of the second filtering component 330 is coupled to a first mode 1-1 of the first filtering component 320, then a part of the first mode 1-1 of the first filtering component 320 is coupled to a single-mode mode 2-1 of the second filtering component 330 through the first independent channel, and the other part of the first mode 1-1 of the first filtering component 320 is coupled to the single-mode mode 2-1 of the second filtering component 330 through the second independent channel.

That is, in the first preset coupling scheme, the second mode 1-2 of the first filtering component 320 and the single-mode mode 2-1 of the second filtering component 330 are coupled through both the first independent channel and the second independent channel. In the second preset coupling scheme, the first mode 1-1 of the first filtering component 320 and the single-mode mode 2-1 of the second filtering component 330 are coupled through both the first independent channel and the second independent channel. Therefore, the first independent channel and the second independent channel are independent of each other spatially. However, with regard to coupling, the first independent channel and the second independent channel are not independent of each other.

In a specific embodiment, the channel distinguishing component 341 may be a cylinder, and the cylinder is made of a material having a relatively low dielectric constant, for example, a metal material such as copper, aluminum, or iron. It is not difficult to understand that the cylinder is merely an example. In another implementation, the channel distinguishing component 341 may alternatively be in another form. This is not specifically limited herein.

In a specific embodiment, the decoupling component 342 is configured to decouple the plurality of independent channels into a plurality of independent coupling channels. The decoupling component 342 is configured to lead any preset coupling to a corresponding independent channel. When both the channel distinguishing component 341 and the decoupling component 342 are disposed, the previous first preset coupling scheme and second preset coupling scheme between the first filtering component 320 and the second filtering component 330 are changed as follows.

In the first preset coupling scheme, a first mode 1-1 of the first filtering component 320 is coupled to a second mode 1-2 of the first filtering component 320, and then the second mode 1-2 of the first filtering component 320 is coupled to a single-mode component 2-1 of the second filtering component 330 through the first independent channel.

In the second preset coupling scheme, a second mode 1-2 of the second filtering component 330 is coupled to a first mode 1-1 of the first filtering component 320, and then the first mode 1-1 of the first filtering component 320 is coupled to a single-mode component 2-1 of the second filtering component 330 through the second independent channel.

That is, in the first preset coupling scheme, the second mode 1-2 of the first filtering component 320 and the single-mode mode 2-1 of the second filtering component 330 are coupled only through the first independent channel. In the second preset coupling scheme, the first mode 1-1 of the first filtering component 320 and the single-mode mode 2-1 of the second filtering component 330 are coupled only through the second independent channel. Therefore, the first independent channel and the second independent channel are independent of each other spatially, and with regard to coupling, the first independent channel and the second independent channel are also independent of each other. In this case, the first independent channel is a first independent coupling channel, and the second independent channel is a second independent coupling channel.

In a specific embodiment, the decoupling component 342 is a component made of metal having good electrical conductivity, such as copper, aluminum, iron, or another metal material; or made of another material plated with copper, aluminum, iron, or another metal material in a manner such as electroplating. It is not difficult to understand that the metal component is merely an example. In another implementation, the decoupling component 342 may alternatively be in another form. This is not specifically limited herein.

In a specific embodiment, a shape of the decoupling component 342 may be one of at least the following three types.

Figure 4A:
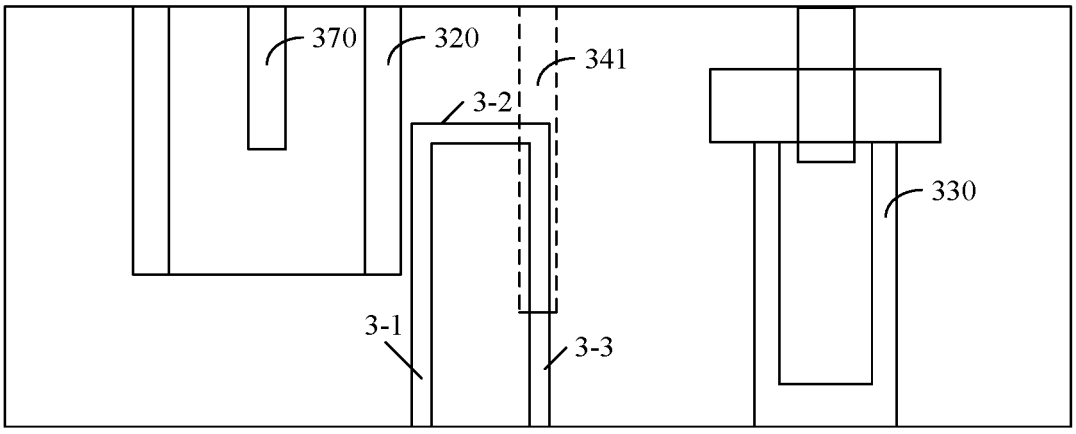
FIG. 4*a* to FIG. 4*c* are schematic structural diagrams of three metal components in a filtering apparatus according to an embodiment of this application.

In a first manner, as shown in FIG. 4*a*, the decoupling component 342 is approximately L-shaped from a top view. A vertical segment of the L-shaped decoupling component 342 is perpendicular to electromagnetic field of any mode of the first filter, and a horizontal segment of the L-shaped decoupling component 342 is parallel to any independent channel. From a side view, the decoupling component 342 is Π-shaped. The Π-shaped decoupling component 342 includes three segments. A first segment 3-1 is perpendicular and connected to the bottom of the casing 310, a second segment 3-2 is parallel to the bottom of the casing 310, and a third segment 3-3 is perpendicular and connected to the bottom of the casing 310. In an optional embodiment, the first segment 3-1 may not be connected to the bottom of the casing 310, the third segment 3-3 may not be connected to the bottom of the casing 310, or neither the first segment 3-1 nor the third segment 3-3 is connected to the bottom of the casing 310. The Π-shaped decoupling component 342 may be solid or hollow.

It needs to be noted that although the foregoing description is made by using an example in which the first segment 3-1 is perpendicular to the bottom of the casing 310, the second segment 3-2 is parallel to the bottom of the casing 310, and the third segment 3-3 is perpendicular to the bottom of the casing 310, in actual application, the first segment 3-1 and the third segment 3-3 may not be completely perpendicular to the bottom of the casing 310, and the second segment 3-2 may not be completely parallel to the bottom of the casing 310 but form an angle with the bottom of the casing 310. That is, being perpendicular herein means being completely perpendicular or forming a non-right angle, and being parallel means being completely parallel or forming an angle.

Figure 4B:
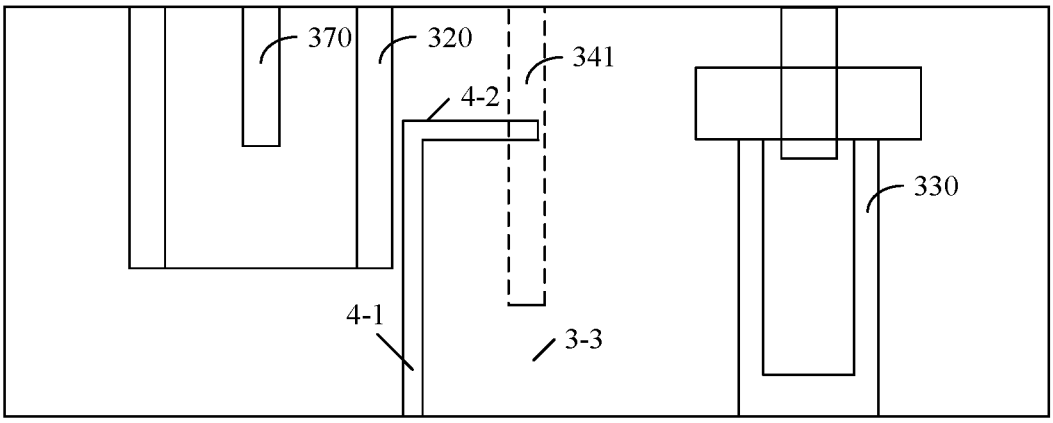
Figure 4C:
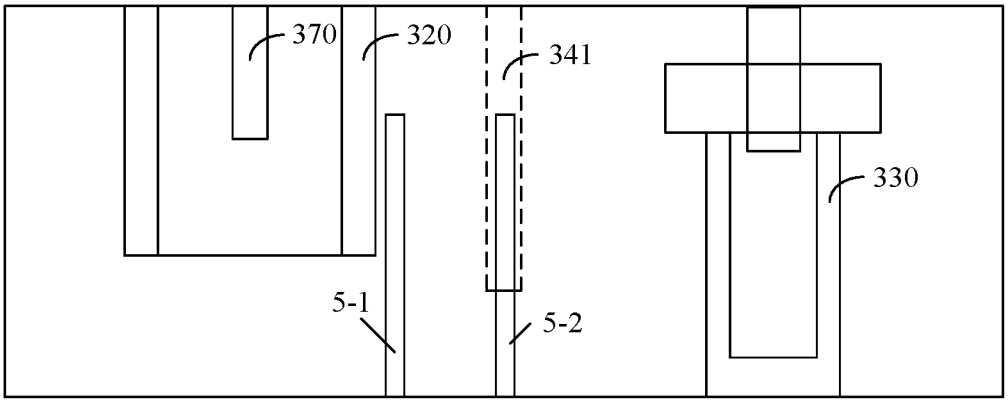

In a second manner, as shown in FIG. 4*b*, the decoupling component 342 is approximately L-shaped from a top view. A vertical segment of the L-shaped decoupling component 342 is perpendicular to electromagnetic field of any mode of the first filter, and a horizontal segment of the L-shaped decoupling component 342 is parallel to any independent channel. From a side view, the decoupling component 342 is upside-down L-shaped, and the L-shaped decoupling component 342 includes two segments. A first segment 4-1 is perpendicular and connected to the bottom of the casing 310, and a second segment 4-2 is parallel to the bottom of the casing 310. In an optional embodiment, the first segment 4-1 may alternatively not be connected to the bottom of the casing 310.

It needs to be noted that although the foregoing description is made by using an example in which the first segment 4-1 is perpendicular to the bottom of the casing 310, and the second segment 4-2 is parallel to the bottom of the casing 310, in actual application, the first segment 4-1 may not be completely perpendicular to the bottom of the casing 310, and the second segment 4-2 may not be completely parallel to the bottom of the casing 310 but form an angle with the bottom of the casing 310. That is, being perpendicular herein means being completely perpendicular or forming a non-right angle, and being parallel means being completely parallel or forming an angle.

In a third manner, as shown in FIG. 4*b*, the decoupling component 342 is approximately L-shaped from a top view. A vertical segment of the L-shaped decoupling component 342 is perpendicular to electromagnetic field of any mode of the first filter, and a horizontal segment of the L-shaped decoupling component 342 is parallel to any independent channel. From a side view, the decoupling component 342 is Π-shaped, and the Π-shaped decoupling component 342 includes two segments. A first segment 5-1 is perpendicular and connected to the bottom of the casing 310, and a second segment 5-2 is perpendicular and connected to the bottom of the casing 310. In an optional embodiment, the first segment 5-1 may not be connected to the bottom of the casing 310, the second segment 5-2 may not be connected to the bottom of the casing 310, or neither the first segment 5-1 nor the second segment 5-2 is connected to the bottom of the casing 310.

It needs to be noted that although the foregoing description is made by using an example in which the first segment 5-1 is perpendicular to the bottom of the casing 310, and the second segment 5-2 is parallel to the bottom of the casing 310, in actual application, the first segment 5-1 and the second segment 5-2 may not be completely perpendicular to the bottom of the casing 310 but form a non-angle with the bottom of the casing 310. That is, being perpendicular herein means being completely perpendicular or forming a non-right angle.

In a specific embodiment, the metal component may be connected to the bottom of the casing 310 through screw fastening, welding, bonding, or another manner. The foregoing example is merely used as an example, and does not need to constitute a specific limitation.

In a specific embodiment of this application, the filtering apparatus may further include at least one adjusting component 350. The at least one adjusting component 350 is in a one-to-one correspondence with at least one enhancing component. Each of the at least one adjusting component is configured to adjust a preset coupling scheme of a corresponding independent coupling channel, and each of the at least one adjusting component is located in the corresponding independent coupling channel. An axis of the corresponding independent coupling channel is used as a first straight line, and each of the at least one adjusting component is located in a corresponding projection area, where the projection area includes a corresponding enhancing component and projections of the corresponding enhancing component in a direction parallel to the first straight line and in a direction perpendicular to the first straight line. It may be understood that, one of the plurality of independent coupling channels may not be provided with a corresponding adjusting component, and in this case, use of the filtering apparatus is not affected.

In a specific embodiment, the plurality of adjusting components 350 may be made of a material having a relatively low dielectric constant, for example, a metal material such as copper, aluminum, or iron, or a semiconductor material such as silicon dioxide. It needs to be understood that the foregoing example is merely used as an example, and does not need to constitute a specific limitation.

In this embodiment of this application, the filtering apparatus may further include at least one enhancing component 360. The at least one enhancing component 360 is in a one-to-one correspondence with the plurality of independent coupling channels, and each of the at least one enhancing component 360 is configured to enhance a coupling degree of a preset coupling scheme of a corresponding independent coupling channel.

In a specific embodiment, the at least one enhancing component 360 may be made of a material having a relatively low dielectric constant, for example, a metal material such as copper, aluminum, or iron, or a semiconductor material such as silicon dioxide. It needs to be understood that the foregoing example is merely used as an example, and does not need to constitute a specific limitation.

In a specific embodiment of this application, the filtering apparatus may further include a mode adjusting component 370. The mode adjusting component 370 is configured to adjust a coupling relationship between the multi-mode components.

In a specific embodiment, the mode adjusting component 370 may be made of a material having a relatively low dielectric constant, for example, a metal material such as copper, aluminum, or iron, or a semiconductor material such as silicon dioxide. It needs to be understood that the foregoing example is merely used as an example, and does not need to constitute a specific limitation.

In the several embodiments provided in this application, it needs to be understood that the disclosed apparatus may be implemented in another manner. For example, the described apparatus embodiments are merely examples. For example, the unit division is merely logical function division and may be other division in actual implementation. For example, a plurality of units or components may be combined or may be integrated into another system, or some features may be ignored or not performed. In addition, the shown or discussed mutual couplings, or direct couplings or communication connections may alternatively be indirect couplings or communication connections through some interfaces, apparatuses, or units, and may be electrical connections, mechanical connections, or connections in another form.

The units described as separate components may be or may not be physically separate. The components shown as units may be or may not be physical units, that is, may be located at one location, or may be distributed on a plurality of network units. Some or all of the units may be selected based on actual requirements to achieve the objectives of the solutions of the embodiments of the present invention.

In addition, functional units in the embodiments of the present invention may be integrated into one processing unit, or each of the units may exist alone physically, or two or more units may be integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present invention essentially, or the part contributing to the prior art, or all or some of the technical solutions may be implemented in a form of a software product. The software product is stored in a storage medium and includes several instructions for instructing a computer device (which may be a personal computer, a server, or a network device) to perform all or some of the apparatus described in the embodiments of the present invention. The foregoing storage medium includes: any medium that can store program code, such as a USB flash drive, a removable hard disk, a read-only memory (ROM, Read-Only Memory), a random access memory (RAM, Random Access Memory), a magnetic disk, or an optical disc.

The foregoing descriptions are merely specific embodiments of the present invention, but are not intended to limit the protection scope of the present invention. Any modification or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A filtering apparatus, wherein the apparatus comprises:

a casing;

a first filtering component and a second filtering component, wherein the first filtering component is a multi-mode component, the second filtering component is a single-mode filtering component, the first filtering component and the second filtering component are separately disposed on two sides of the casing, and the first filtering component and the second filtering component are coupled to each other through a coupling channel;

a coupling channel distinguishing component, located between the first filtering component and the second filtering component, and dividing the coupling channel between the first filtering component and the second filtering component into a plurality of independent coupling channels, wherein the plurality of independent coupling channels are in a one-to-one correspondence with a plurality of preset coupling schemes, the coupling channel distinguishing component comprises a channel distinguishing component and at least one decoupling component, the channel distinguishing component is configured to divide the plurality of independent coupling channels into a plurality of independent channels, and the at least one decoupling component is configured to decouple the plurality of independent channels into the plurality of independent coupling channels; and at least one adjusting component, wherein the at least one adjusting component is in a one-to-one correspondence with the at least one decoupling component, each of the at least one adjusting component is configured to adjust a preset coupling scheme of a corresponding one of the plurality of independent coupling channels, each of the at least one adjusting component is located in the corresponding independent coupling channel, an axis of the corresponding independent coupling channel is used as a first straight line, and each of the at least one adjusting component is located in a corresponding projection area, wherein the projection area includes a corresponding enhancing component and projections of the corresponding enhancing component in a direction parallel to the first straight line and in a direction perpendicular to the first straight line.

2. The apparatus according to claim 1, wherein the channel distinguishing component comprises at least one cylinder, and a material of the cylinder is a metal material.

3. The apparatus according to claim 1, wherein the decoupling component is approximately L-shaped from a top view, a vertical segment of the L-shaped decoupling component is perpendicular to electromagnetic field of any mode of the first filter, and a horizontal segment of the L-shaped decoupling component is parallel to any one of the independent channels; and from a side view, the decoupling component is Π-shaped, the Π-shaped decoupling component includes three segments, a first segment is perpendicular to a bottom of the casing, a second segment is parallel to the bottom of the casing, and a third segment is perpendicular to the bottom of the casing.

4. The apparatus according to claim 3, wherein the first segment is connected to the bottom of the casing, and the third segment is connected to the bottom of the casing;

the first segment is not connected to the bottom of the casing, and the third segment is connected to the bottom of the casing;

the first segment is connected to the bottom of the casing, and the third segment is not connected to the bottom of the casing; or the first segment is not connected to the bottom of the casing, and the third segment is not connected to the bottom of the casing.

5. The apparatus according to claim 1, wherein the decoupling component is approximately L-shaped from a top view, a vertical segment of the L-shaped decoupling component is perpendicular to electromagnetic field of any mode of the first filter, and a horizontal segment of the L shape is parallel to any one of the independent channels; and from a side view, the decoupling component is upside-down L-shaped, the upside-down L-shaped decoupling component includes two segments, a first segment is perpendicular to a bottom of the casing, and a second segment is parallel to the bottom of the casing.

6. The apparatus according to claim 5, wherein the first segment is connected to the bottom of the casing, or the first segment is not connected to the bottom of the casing.

7. The apparatus according to claim 1, wherein the decoupling component is approximately L-shaped from a top view, a vertical segment of the L-shaped decoupling component is perpendicular to electromagnetic field of any mode of the first filter, and a horizontal segment of the L-shaped decoupling component is parallel to any one of the independent channels; and from a side view, the decoupling component is ||-shape, the ||-shaped decoupling component includes two segments, a first segment is perpendicular to a bottom of the casing, and a second segment is perpendicular to the bottom of the casing.

8. The apparatus according to claim 7, wherein the first segment is connected to the bottom of the casing, and the second segment is connected to the bottom of the casing;

the first segment is not connected to the bottom of the casing, and the second segment is connected to the bottom of the casing;

the first segment is connected to the bottom of the casing, and the second segment is not connected to the bottom of the casing; or the first segment is not connected to the bottom of the casing, and the second segment is not connected to the bottom of the casing.

9. The apparatus according to claim 1, wherein the filtering apparatus further comprises at least one enhancing component, and each of the at least one enhancing component is configured to enhance a coupling degree of a preset coupling scheme of a corresponding independent coupling channel.

10. The apparatus according to claim 9, wherein each of the at least one enhancing component is made of a metal material.

* * * * *